US007448174B2

(12) United States Patent
Krochmal et al.

(10) Patent No.: US 7,448,174 B2
(45) Date of Patent: Nov. 11, 2008

(54) INTEGRAL SCREWLESS WINDOW ASSEMBLY

(75) Inventors: Andrew R. Krochmal, Grand Haven, MI (US); Benjamin P. Hummel, Fennville, MI (US)

(73) Assignee: ODL, Incorporated, Zeeland, MI (US)

( * ) Notice: Subject to any disclaimer, the term of this patent is extended or adjusted under 35 U.S.C. 154(b) by 0 days.

(21) Appl. No.: 11/382,362

(22) Filed: May 9, 2006

(65) Prior Publication Data

US 2007/0261326 A1 Nov. 15, 2007

(51) Int. Cl.
*E06B 1/04* (2006.01)
*E04G 23/00* (2006.01)

(52) U.S. Cl. ..... 52/204.54; 52/127.8; 52/205; 52/212; 52/656.2

(58) Field of Classification Search ..... 52/204.54, 52/204.53, 212, 211, 656.5, 656.6, 656.7, 52/656.2, 656.1, 455, 456, 457, 127.7, 127.8, 52/127.9, 208, 205
See application file for complete search history.

(56) References Cited

U.S. PATENT DOCUMENTS 3,423,897 A 1/1969 Birum, Jr.
4,407,100 A * 10/1983 Huelsekopf ..... 52/204.54
4,640,078 A 2/1987 Haffer
4,897,975 A 2/1990 Artwick et al.
4,920,718 A 5/1990 Artwick et al.
4,947,597 A 8/1990 Simpson
5,137,323 A 8/1992 Gross et al.
5,189,862 A 3/1993 Lafleur
5,323,465 A 6/1994 Avarne
5,323,579 A 6/1994 Ruff
5,369,922 A * 12/1994 Hansen ..... 52/204.54
5,373,671 A 12/1994 Roth et al.
5,557,899 A 9/1996 Dube et al.
5,711,120 A 1/1998 Karpen
5,713,167 A 2/1998 Durham et al.
5,941,032 A 8/1999 Lydon, Jr.
6,058,667 A 5/2000 MacDonald et al.
6,101,772 A * 8/2000 Leonard et al. ..... 52/204.53
6,151,849 A 11/2000 Twigg et al.
6,158,179 A 12/2000 Ackerly et al.
6,272,801 B1 8/2001 Suh
6,434,898 B1 8/2002 Ward et al.
6,513,288 B1 2/2003 MacDonald et al.
6,553,735 B1 4/2003 Wang Chen
6,619,005 B1 9/2003 Chen
6,694,701 B2 * 2/2004 Wang et al. ..... 52/783.1
6,708,458 B1 3/2004 Berger, Jr.
6,729,095 B2 5/2004 Wang Chen
D496,470 S 9/2004 Tjakra et al.
6,829,868 B1 12/2004 Frey
6,837,011 B2 1/2005 Berger, Jr.
6,925,767 B2 * 8/2005 Krochmal et al. ..... 52/455
6,931,810 B2 8/2005 Beaudoin et al.

(Continued)

*Primary Examiner*—Robert Canfield
*Assistant Examiner*—Jessie Fonseca
(74) *Attorney, Agent, or Firm*—Warner Norcross & Judd LLP

(57) ABSTRACT

A window assembly including a permanent frame portion, a removable frame portion, and a glazing panel sandwiched between. The frame portions are easily installed and include integral releasable connectors accessible using a thin tool inserted into a groove between the two frame portions. The removable frame portion can be removed from the permanent frame portion using a thin tool. With the removable frame portion removed, the insulated glass panel may be easily replaced.

9 Claims, 4 Drawing Sheets

U.S. PATENT DOCUMENTS

| | | | | |
|---|---|---|---|---|
| 7,107,736 | B2 * | 9/2006 | Barnard | 52/745.15 |
| 2003/0029104 | A1 | 2/2003 | Leonard | |
| 2003/0056442 | A1 * | 3/2003 | Gerard | 49/504 |
| 2004/0000109 | A1 | 1/2004 | Bourassa et al. | |
| 2004/0068942 | A1 * | 4/2004 | Krochmal et al. | 52/204.71 |
| 2006/0005481 | A1 * | 1/2006 | Ouellette | 52/204.1 |

* cited by examiner

INTEGRAL SCREWLESS WINDOW ASSEMBLY

BACKGROUND OF THE INVENTION

The present invention relates to window assemblies, and more particularly to window assemblies in which the glass can be readily removed from the frame.

Known integral window assemblies include a first frame half structurally incorporated within a door or other supporting structure, a glass or other glazing panel mounted within the first frame half, and a plurality of glazing retainers or stops (which together act as a second frame half) for securing the glazing panel in the frame. Examples of these constructions are shown in U.S. Pat. No. 4,897,975 issued Feb. 6, 1990 to Artwick et al, and U.S. Pat. No. 6,434,898 issued Aug. 20, 2002 to Ward et al. These units are designed for one-time assembly and can be difficult to install. Once installed, the glazing retainers cannot be readily removed. Consequently, removal and replacement of the glass is undesirably difficult, if not impossible. However, replacement is necessary for practical reasons, such as glass breakage. And replacement is desirable for cosmetic reasons, such as a consumer's changing tastes or desire to upgrade the decor.

SUMMARY OF THE INVENTION

The aforementioned problems are overcome by the present invention wherein a window assembly includes a second frame half that is readily removable from a first frame half using a handheld tool, which enables glass to be easily removed from and/or installed in the frame.

In the disclosed embodiment, the first and second frame halves include integral connectors that securely connect the frame halves when they are fitted together. The connectors can be readily disengaged simply by inserting a thin tool between the two frame halves. Preferably, the connectors are flexible barbs positioned about one of the frame halves. When the frame halves are interfitted, the barbs snap into receivers. Each barb includes a cam or ramp. When inserted, the thin tool rides along the ramp to flex each barb out of engagement with the associated receiver, enabling the two frame halves to be separated.

Also disclosed is a method of replacing a glass panel in a window assembly including the steps of inserting a thin tool between a first frame portion and a second frame portion to disengage a connection between the two frame portions, removing the second frame portion for the first frame portion, removing the glass panel, positioning a replacement glass panel in the first frame portion, and reinstalling the second frame portion so that the connection reengages.

The present invention enables the glazing panel in a window assembly to be readily replaced. Such replacement is absolutely necessary in cases of breakage. Additionally, consumers now have the option of readily changing the panel for aesthetics, seasonal, or other optional reasons.

These and other objects, advantages, and features of the invention will be more fully understood and appreciated by reference to the description of the current embodiment and the drawings.

DESCRIPTION OF THE CURRENT EMBODIMENT

Figure 1:
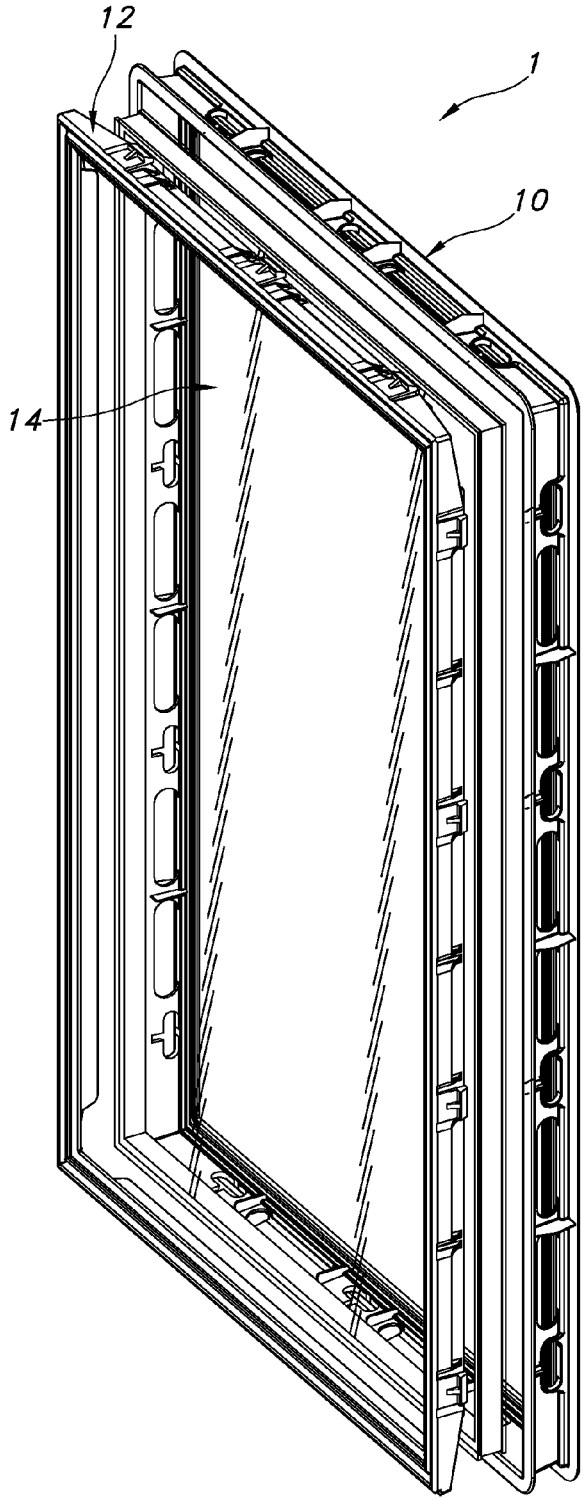
FIG. 1 is a perspective exploded view of the window frame halves.

A window assembly constructed in accordance with the current embodiment of the invention is illustrated in the drawings and generally designated 1. The assembly includes a first or permanent frame half 10, a second or removable frame half 12, and a glazing panel 14. The permanent frame half is adapted to be integrated into a door, and the removable frame half is adapted to be removably installed in the permanent frame half to support the glazing panel therebetween.

Although the current embodiment of this invention is a doorglass assembly, it will be appreciated by those skilled in the art that the invention is extendable to a wide variety of additional window applications. For example, the invention could be incorporated into sidelights, decorative bath windows, bay windows, or other windows. The invention also could be incorporated into a window assembly that is not integrated into a door.

The removable frame half 12 includes integral barbed connectors 30, and the permanent frame half 10 defines receivers or apertures 40 for receiving the connectors. When the two frame halves are fully interfitted, the connectors 30 snap fit into the receivers 40. When the removable frame half is to be removed, a thin tool 13 is inserted between the frame halves to disengage the connectors 30 from the receivers 40. With the connectors disengaged, the second frame half can be removed from the first frame half; and the glazing panel 14 can be easily removed for replacement with another glazing panel (not shown).

The connector 30 and the receiver 40 together provide a thin tool release mechanism enabling a glass panel to be removed from a two-piece frame assembly. When the flexible barbs snap into the apertures, the two frame halves are locked together to support and to secure the glazing panel therebetween. The frame halves cannot be separated without the use of a thin tool, which is required to disengage the flexible barbs. The frames can be separated either using a single thin tool or using multiple thin tools. If a single tool is used, each connector is sequentially disengaged as the second frame half is eased from the first frame half. If multiple tools are used, the connectors are collectively disengaged before the second frame half is withdrawn at once.

FIG. 1 shows the current embodiment of the window frame. The permanent frame half 10 and removable frame half 12 may be any suitable material. In the current embodiment, each of the frame halves or portions are a one-piece injection-molded plastic part. Alternatively, either frame half could be fabricated of multiple pieces, for example extrusions, or any other suitable construction.

Figure 2:
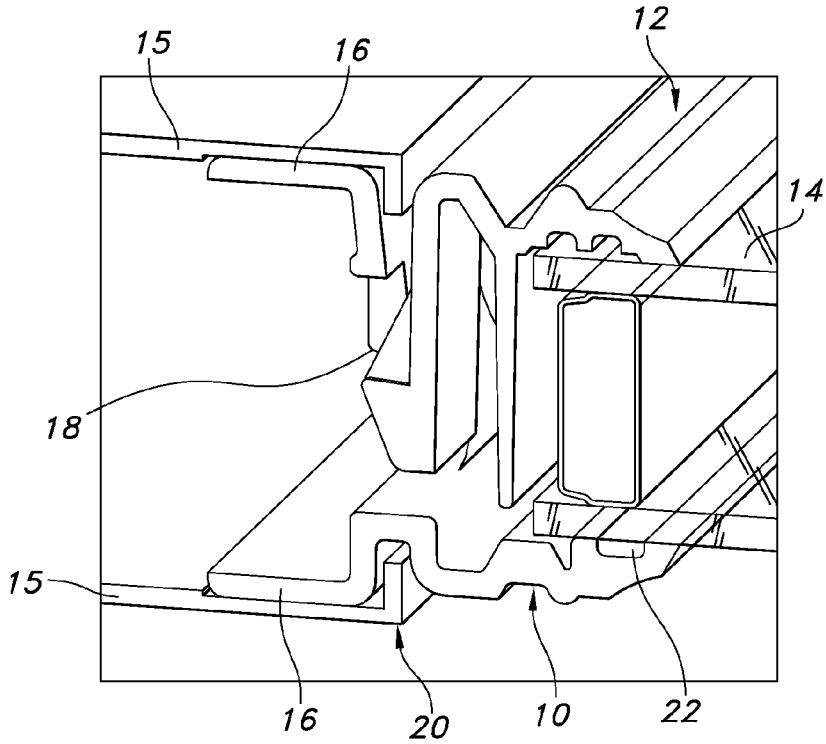
FIG. 2 is a perspective sectional view of the assembled window assembly.

FIG. 2 is a perspective sectional view of the window assembly including the frame and the glazing panel. The glazing panel can be a single piece of glass, polycarbonate, or other suitable material. The glazing panel also may be an insulated construction and/or a decorative glass construction. In short, the glazing panel can be any structure or assembly providing transparency and/or translucency.

The permanent frame half 10 is designed for incorporation into a door during manufacture of the door. The door (not shown) may include a door core (not shown) and a door skin 15. The door core may be any suitable structural and/or insulative material such as expanded polyurethane or polystyrene foam block. The door skin 15 may be made of any suitable material such as steel, fiberglass, or plastic. The permanent frame half 10 includes flanges 16 which extend under the door skin 15. The flanges 16 aid in the secure attachment and sealing of the permanent frame half 10 to the door skin 15. The edges 20 of the door skin 15 are folded around the permanent frame half 10 toward the center of the door, to secure the permanent frame half 10. In one embodiment, the edges 20 of the door skin 15 extend into grooves in the permanent frame half 10. Epoxy or other suitable adhesive secures the permanent frame half 10 to the door skin.

The removable frame portion 12 interfits with the permanent frame half 10. As disclosed, the permanent frame half 10 and the removable frame half 12 forms a converging channel 19. The converging channel 19 may be formed at any suitable angle, and the width of the channel is such as to allow a thin tool to be forced into the channel to disengage the connectors. In the current embodiment, the channel is formed at an angle of approximately five degrees.

Figure 3:
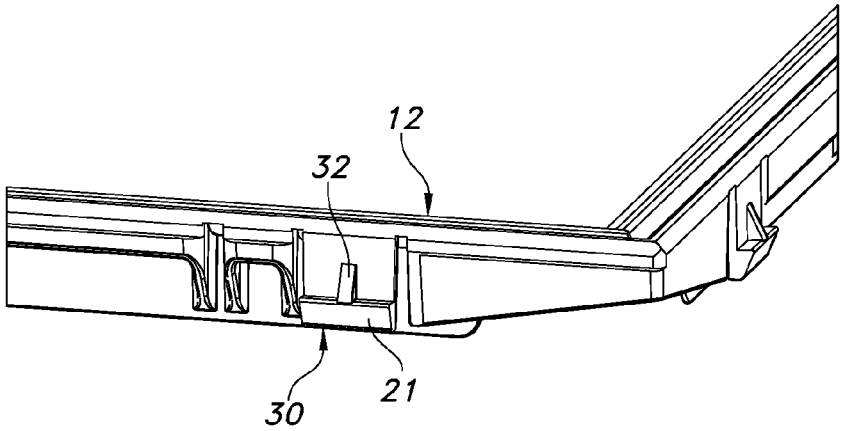
FIG. 3 is a perspective view of a corner of the removable frame half.

FIG. 3 is a perspective view of a corner of the removable frame half. Each of the flexible barbs 30 includes a cam or ramp 32 along which the thin tool slides when inserted between the permanent frame portion 10 and the removable frame portion 12. Consequently, the barb 21 on the connector 30 is withdrawn from the receiver 40 as the thin tool is inserted. The removable frame portion 10 preferably includes a seal or gasket 22, which could be co-molded, foamed in place, a hot melt "wet seal," a silicone caulk, foam tape or another suitable material.

The glass panel 14 may be connectable to the removable frame portion 12. For example, the glass panel could snap into the frame portion without glue. Also, the removable frame portion 12 could include a molded seal for providing a seal between the removable frame and the permanent frame. It is currently expected that the removable frame would be on the interior side of the door for security reasons. It is possible that the removable frame could be on the exterior side of the door. In that case, the connectors would be keyed (in some manner not shown) to prevent unauthorized access.

Figure 4:
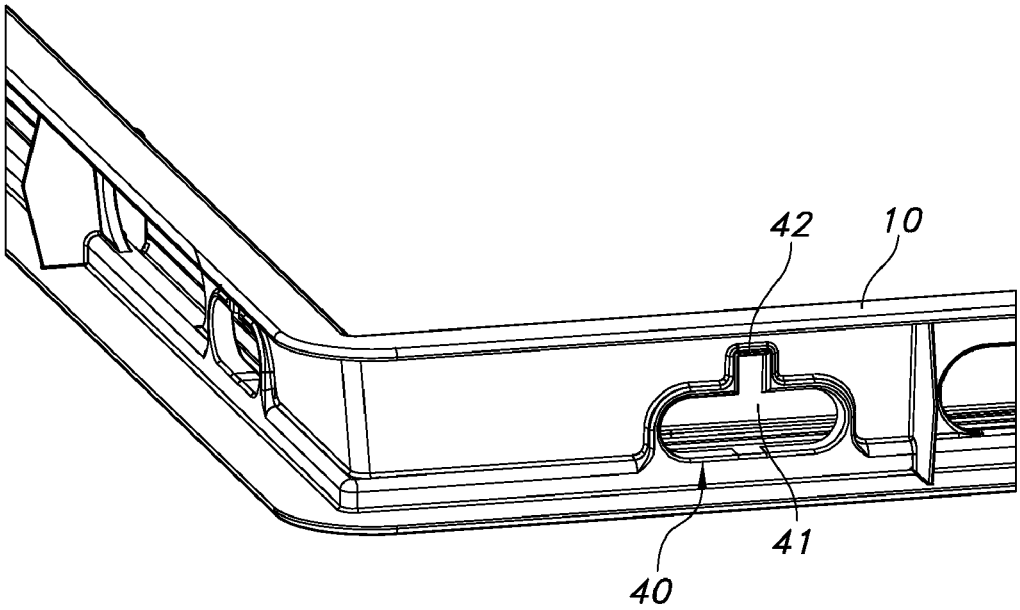
FIG. 4 is a perspective view of a corner of the permanent frame half.

FIG. 4 is a perspective view of a corner of the permanent frame half. The permanent frame portion 10 includes a plurality of apertures or receivers 40 for receiving the connectors 30. In the current embodiment, the apertures 40 are identical to one another. That is not necessary. Each connector is essentially T-shaped including one portion 41 for receiving the barb 21 and another portion 42 for receiving the ramp 32 of the associated barb 30. Further, as more clearly shown in FIG. 6, the apertures may be formed at an angle to create a catch 18 which in turn forms a converging channel between the permanent frame portion 10 and the removable frame portion 12. The permanent frame portion 10 may include a seal gasket molded on during manufacture, foamed on as in foam in place gasket, or placed on as a separate o-ring type part.

Figure 5:
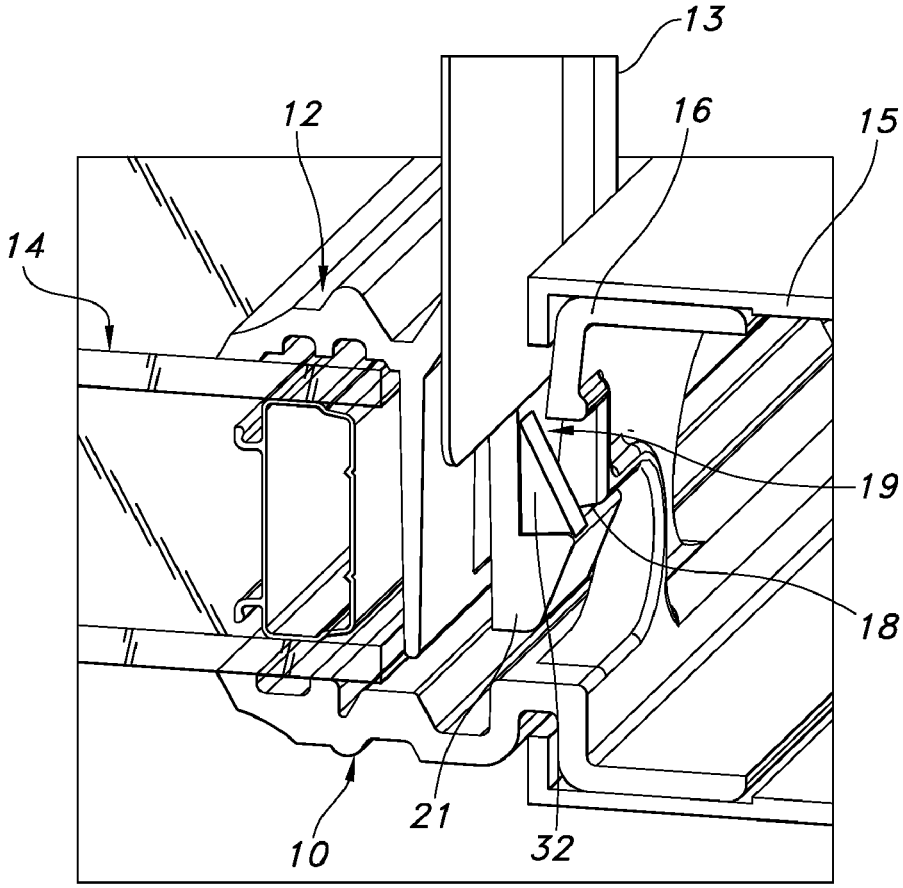
FIG. 5 is perspective sectional view of the assembled window assembly showing the initial insertion of a thin tool in order to release a connector.

FIG. 5 is perspective sectional view of the assembled window assembly showing the initial insertion of a thin tool in order to release a connector. In the current embodiment, the thin tool is simply a credit card or other plastic ID card. Other possible thin tools include a putty knife or a screwdriver; and the thin tool 13 can be any object sufficiently thin to fit within the channel 19 and sufficiently rigid to flex the connectors 30.

Figure 6:
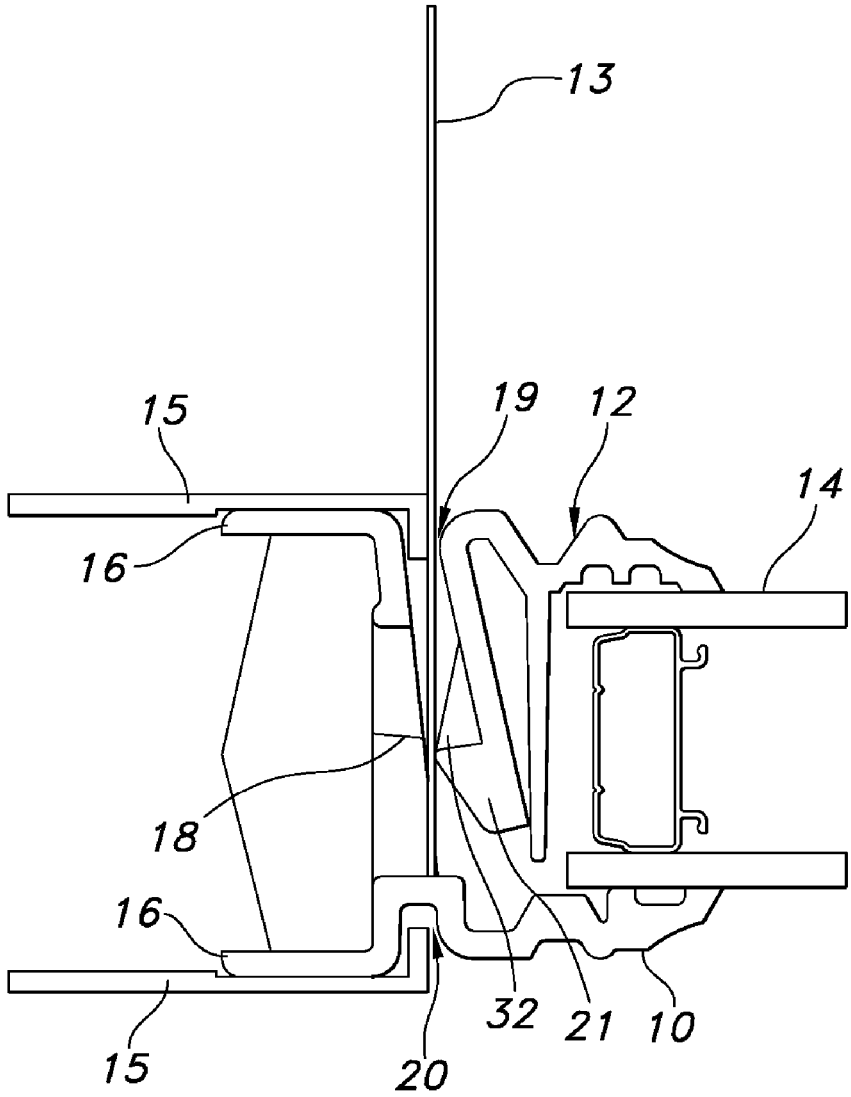
FIG. 6 is a sectional view of the assembled window assembly showing the thin tool fully inserted and the connector released.

FIG. 6 is a sectional view of the assembled window assembly showing the thin tool fully inserted and the connector released. The thin tool 13 rides along the ramp 32 to flex the barb 21 out of engagement with the receiver 40, enabling the two frame halves to be separated.

Preferably, the connectors 30 are not manually accessible (i.e. directly with the hands rather than with one or more thin tools). This both enhances the aesthetics of the assembly 1 and also reduces the likelihood of mischievous, or even inadvertent, removal of the glazing panel. However, the frame can be opened relatively easily using the thin tool(s). The ease with which the removable frame portion 12 can be removed from the permanent frame portion 10 facilitates glass replacement as might be necessary in cases of breakage or as might be desirable simply to change the style or functionality of the glass.

Preferably, the mating surfaces on the barbed connectors 30 and the receivers 40 are back-angled to provide a self-locking design. Until a thin tool is inserted, any force urging the removable frame half 12 from the permanent frame half 10 also urges the connectors 30 more firmly into engagement with the receivers 40.

A method of replacing the glazing panel 14 of the window assembly 1 is provided. The method includes 1) inserting a thin tool between the permanent frame portion 10 and the removable frame portion 12 of the integral frame assembly to disengage a connector 30, 2) removing the removable frame portion and the glazing panel from the permanent frame portion, 3) placing a new glazing panel in the permanent frame portion, and 4) reinstalling the removable frame portion on the permanent frame portion until the connector reengages.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A window assembly for a door comprising:

a glazing panel;

a first frame portion having a periphery and adapted to be independently supported by the door;

a second frame portion adapted to be supported by said first frame portion, said second frame portion releasably connected to said first frame portion to support said glazing panel therebetween;

said first frame portion and said second frame portion defining a channel therebetween, said channel extending continuously around said periphery of said first frame portion, said channel opening in a direction generally perpendicular to said glazing panel, said channel defined by said first frame portion on one side and said second frame portion on the other side, said channel permitting insertion of a thin tool into said channel; and said first and second frame portions including connector means aligned with and accessible only through said channel for releasably connecting said frame portions together, said connector means being manually inaccessible when said frame portions are connected, said connector means being accessible and releasable by at least one thin tool inserted into said channel into engagement with said connector means.

2. A window assembly as defined in claim 1 wherein:

each of said frame portions comprises a single piece; and said connector means are integral with said first and second frame portions.

3. A window assembly as defined in claim 1 wherein said connector means includes a barb.

4. A window assembly as defined in claim 1 wherein said connector means comprises:

a plurality of connectors on one of said frame portions; and a plurality of receivers on the other of said frame portions.

5. A window assembly for a door comprising:

a permanent frame portion having a periphery and adapted to be independently supported by said door;

a removable frame portion adapted to be supported by said permanent frame portion, said removable frame portion releasably connected to said permanent frame portion, said permanent frame portion and said removable frame portion defining a channel, said channel extending continuously around said periphery of said first frame portion, one side of said channel defined by said permanent frame portion and the other side of said channel defined by said removable frame portion, said channel permitting insertion of a thin tool into said channel;

an insulated glazing panel removably sandwiched between said removable frame portion and said permanent frame portion, said channel opening in a direction generally perpendicular to said glazing panel; and a releasable connection between said removable frame portion and said permanent frame portion, said releasable connection aligned with and accessible only through said channel, said releasable connection being accessible and releasable by insertion of said thin tool into said channel and into engagement with said releasable connection.

6. The window assembly of claim 5 wherein said door is a residential door.

7. The window assembly of claim 5 wherein said releasable connection comprises a plurality of flexible barbed connectors about said periphery.

8. A window assembly comprising:

a base frame portion adapted to be independently supported by a structure, said base frame portion having a periphery, said base frame portion defining a plurality of receivers, each receiver including a ramp receiving portion and a barb receiving portion;

a cover frame portion adapted to be supported by said base frame portion, said cover frame portion releasably connected to said base frame portion, said cover frame portion including a plurality of connectors each fitting into one of said receivers, each connector including a flexible barb and a ramp, each flexible barb interfitting with a corresponding barb receiving portion of one of said receivers and each ramp interfitting with a corresponding ramp receiving portion of one of said receivers when said cover frame portion is installed within said base frame portion, said base frame portion and said cover frame portion defining a channel therebetween, said channel extending continuously about said periphery of said base frame portion, one side of said channel defined by said base frame portion and the other side of said channel defined by said cover frame portion, said channel permitting insertion of a thin tool into said channel, said flexible barb of each connector aligned with and accessible only through said channel, each connector being accessible by a thin tool inserted into said channel and into engagement with said ramp of said each connector, enabling said barb to be withdrawn from its associated receiver; and a glazing panel between said base frame portion and said cover frame portion said channel opening in a direction generally perpendicular to said glazing panel.

9. The window assembly of claim 8 wherein said barb receiving portion comprises a catch.

* * * * *